United States Patent [19]

Crow et al.

[11] Patent Number: 4,573,944

[45] Date of Patent: Mar. 4, 1986

[54] BALL SWINGING TOY VEHICLE

[75] Inventors: Granville Crow, Lomita; Larry H. Renger, Hawiian Gardens; Roger H. Sweet, Long Beach, all of Calif.

[73] Assignee: Mattel, Inc., Hawthorne, Calif.

[21] Appl. No.: 688,837

[22] Filed: Jan. 4, 1985

[51] Int. Cl.[4] ..... A63H 17/00

[52] U.S. Cl. ..... 446/465; 446/336

[58] Field of Search ..... 446/465, 431, 435, 409, 446/410, 413, 414, 336, 334, 335, 333, 271, 290, 291

[56] References Cited

U.S. PATENT DOCUMENTS

| | | | |
|---|---|---|---|
| 6554 | 6/1849 | Thomas . | |
| 2,397,994 | 4/1946 | Walker | 89/1 |
| 2,460,322 | 5/1945 | Walker | 89/1 |
| 2,611,340 | 12/1952 | Manning | 119/153 |
| 3,000,137 | 9/1961 | Vine | 446/435 X |
| 3,148,478 | 9/1964 | Miller | 46/74 |
| 3,466,053 | 11/1969 | Whaley | 272/65 |
| 3,548,702 | 12/1970 | Kosuge | 446/410 X |
| 3,703,785 | 11/1972 | Pfeilsticker et al. | 446/427 |
| 3,807,802 | 4/1974 | Betters | 299/37 |
| 4,072,354 | 2/1978 | Holmes . | |

FOREIGN PATENT DOCUMENTS 488772 7/1938 United Kingdom .

*Primary Examiner*—Mickey Yu

*Attorney, Agent, or Firm*—Ronald M. Goldman; Melvin A. Klein

[57] ABSTRACT

A toy vehicle having an arm with a ball at the end thereof pivotable relative to an axle of the vehicle from a nested position to a position forward of the vehicle, the mechanism being actuated by depression of a push lever, upon which a spring-biased rack member is mannually actuated against the force of the spring to a rearward position, the rack member engaging a pinion gear member rotatable relative to the axle, which, through a clutch controlled coupling device pivots the arm and ball about the axle into engagement with the surface or an object in advance of the vehicle.

15 Claims, 5 Drawing Figures

10
12
12'
12"
12c
13
14
15
16
17
18
20
22
26
2
2

BALL SWINGING TOY VEHICLE

BACKGROUND OF THE INVENTION

The background of the invention will be discussed in two parts:

Field of the Invention

This invention relates to toy vehicles, and more particularly to a toy vehicle having an actuable arm member with a ball at the end thereof for simulating a weapon.

Decription of the Prior Art

Heavy weights and pivotable, extended arm members have been used on vehicles intended for demolition or on vehicles, such as tanks, for mine detection and detonation. In the former category, U.S. Pat. Nos. 3,807,802 and 4,072,354 are exemplary. The first patent, entitled "Demolition Machine", issued Apr. 30, 1974 to Betters, shows and describes a device for attachment to the bucket of a high lift machine, the device including an arm fixed to the bucket with the free end of the arm having a weighted wrecking implement, which may have a forked configuration for demolition purposes. The second patent, entitled "Breaker Apparatus", issued Feb. 7, 1978 to Holmes, shows a piece of heavy equipment including a vehicle with a "breaker bar" coupled to a linkage hydraulically actuated for raising and lowering the breaker bar to cause it to strike a surface to be broken.

In the latter category, "mine sweepers" are shown and described in U.S. Pat. Nos. 2,397,994 and 2,460,322. In the first of these patents, entitled "Antitank Mine Clearing Device", issued Apr. 9, 1946 to Walker, a centrifugal arm is pivotally mounted to the turret of an armored vehicle, such as a tank, for rotation with the opposite ends of the arm having attached thereto a pair of weighted spheres through flexible coupling means such as chains, the weighted members, upon rotation, thrashing the ground to detonate mines. In the second of these patents, entitled "Mine Exploder", issued Feb. 1, 1949 to Walker, a plurality of L-shaped "tamping arms" are pivotally coupled to a common shaft at the front end of the armored vehicle, with cam actuators and spring members, repeatedly and forcibly actuating the free ends aginst the ground for detonating mines in advance of the path of the vehicle.

The use of spring-loaded pivotable arms or devices have been used in such things as traps and catapults. U.S. Pat. No. 6,554, issued on June 26, 1849 to Thomas, depicts a "Jaw Trap" having spiked members on a pivotable frame for capturing or killing rodents or the like. U.S. Pat. No. 3,466,053, issued Sept. 9, 1969 to Whaley for a "Combined Diving Catapult and Swimming Pool" illustrates the use of a pivotable spring loaded arm with a seat at the end thereof for catapulting a person seated therein into a swimming pool.

Another use of a ball device on a flexible coupling is shown in U S. Pat. No. 2,611,340, issued Sept. 23, 1952 to Manning for a "Mechanical Bola", the device being attached to the front end or bumper of a Jeep type vehicle, and including a horizontally pivotable spring arm having a six foot rope with a weighted pear-shaped member at the end thereof. Pivoting the arm under force of the spring from a position alongside the vehicle to its extended position in front of the vehicle, causes the "bola" or rope and weight to encircle the legs of cattle or the like for capture.

The use of pivotable members in toy vehicles is exemplified by British Pat. No. 488,772, accepted July 13, 1938, for a "Toy Vehicle", which is a "fire truck" with a two part extension ladder pivotally mounted thereon, and held in the folded position against the action of two springs with the raising and unfolding being accomplished via a manually operable shaft.

A "Missile Launcher Toy" is shown and described in U.S. Pat. No. 3,148,478, issued Sept. 15, 1964 to Miller. The vehicle is battery operated and includes a pivotable missile launch mechanism at the rear end thereof with a latch arm retaining the missile on the launcher. After pivoting of the launch mechanism through a certain angle, the latch arm releases the missile under force of a spring into the air.

It is an object of the present invention to provide a new and improved toy vehicle with an actuable arm member.

It is another object of the present invention to provide a new and improved toy vehicle with a pivotable arm member having a simulated weighted object at the end thereof, It is a further object of the present invention to provide a new and improved action vehicle.

SUMMARY OF THE INVENTION

The foregoing and other objects are accomplished by providing a toy vehicle having an arm with a ball at the end thereof pivotable relative to an axle of the vehicle from a nested position to a position forward of the vehicle, the mechanism being actuated by depression of a push lever, upon which a spring-biased rack member is manually actuated against the force of the spring to a rearward position, the rack member engaging a pinion gear member rotatable relative to the axle, which through a clutch controlled coupling device operates the arm and ball into pivoting about the axle into engagement with the surface or an object in advance of the vehicle.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
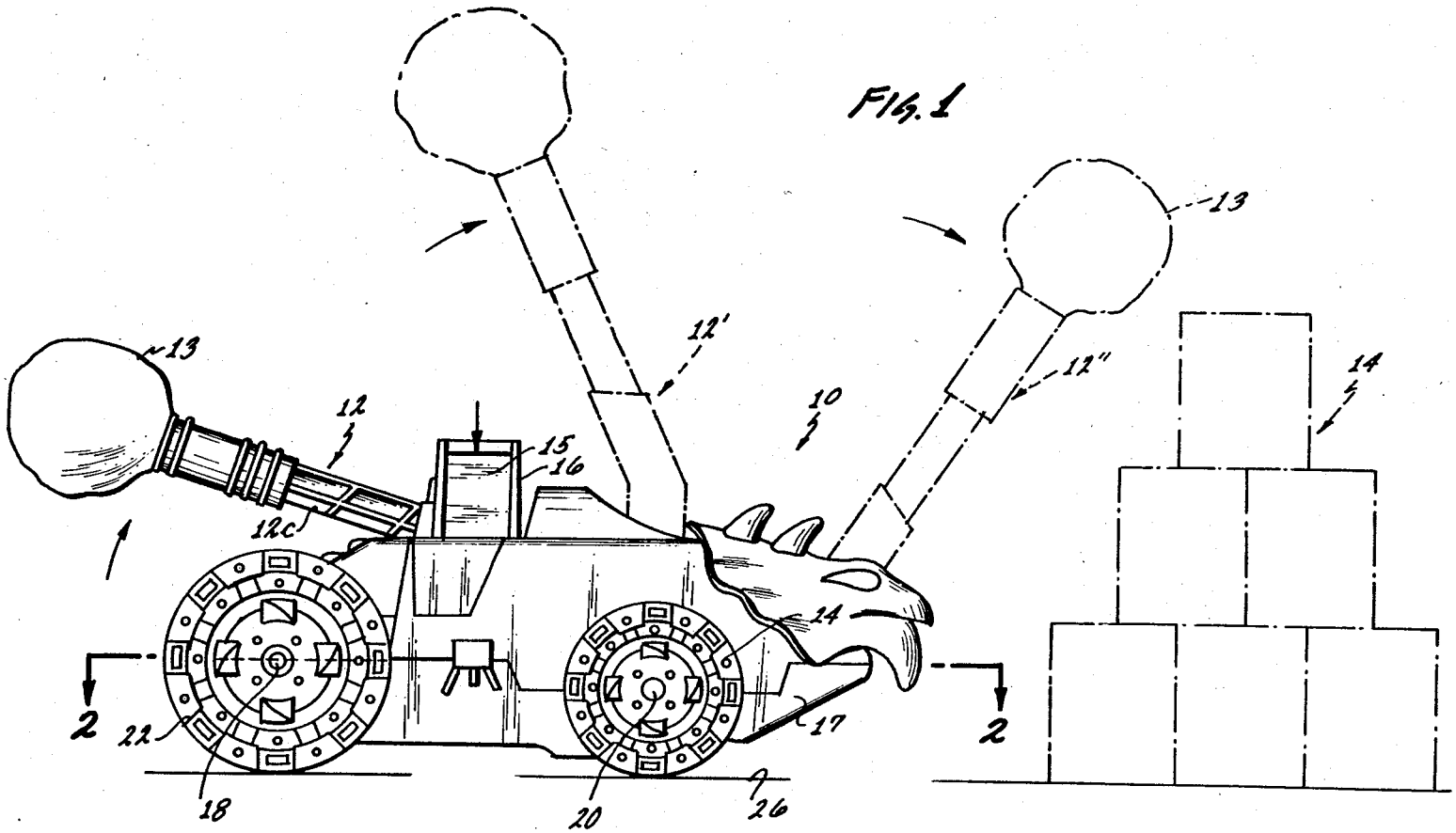
FIG. 1 is a side elevational view of the ball swinging toy vehicle according to the present invention.

Referring now to the drawings, and particularly to FIG. 1, there is shown a vehicle generally designated 10, having an arm member, generally designated 12, pivotally coupled thereto, the arm member 12 having a ball member 13 at the end thereof, the arm member 12 being shown in dotted line positions, designated 12′ and 12″ with arrows adjacent thereto indicating the direction of pivoting of the arm member 12. A dotted line depiction of a stack of cubes 14 are illustrated in the path of pivoting of the arm member 12 for impact by the ball 13. Actuation of the arm 12 and ball 13 is accomplished by manual depression of an operating lever 15 supported within an upwardly extending guide portion 16 of the housing 17.

Figure 2:
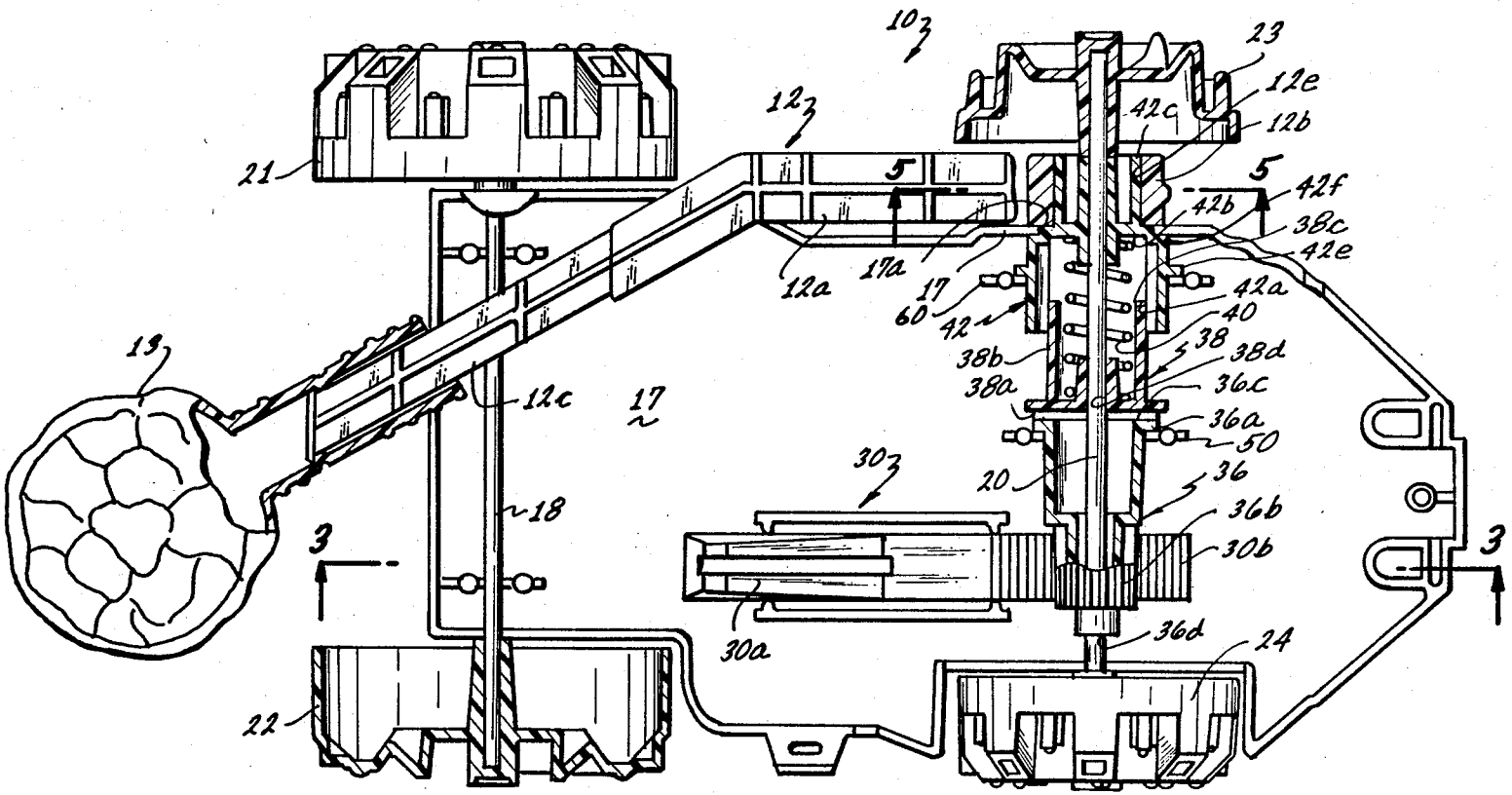
FIG. 2 is a plan view, partially in cross-section of the ball swinging toy vehicle of FIG. 1 as viewed generally along line 2—2 thereof.
Figure 3:
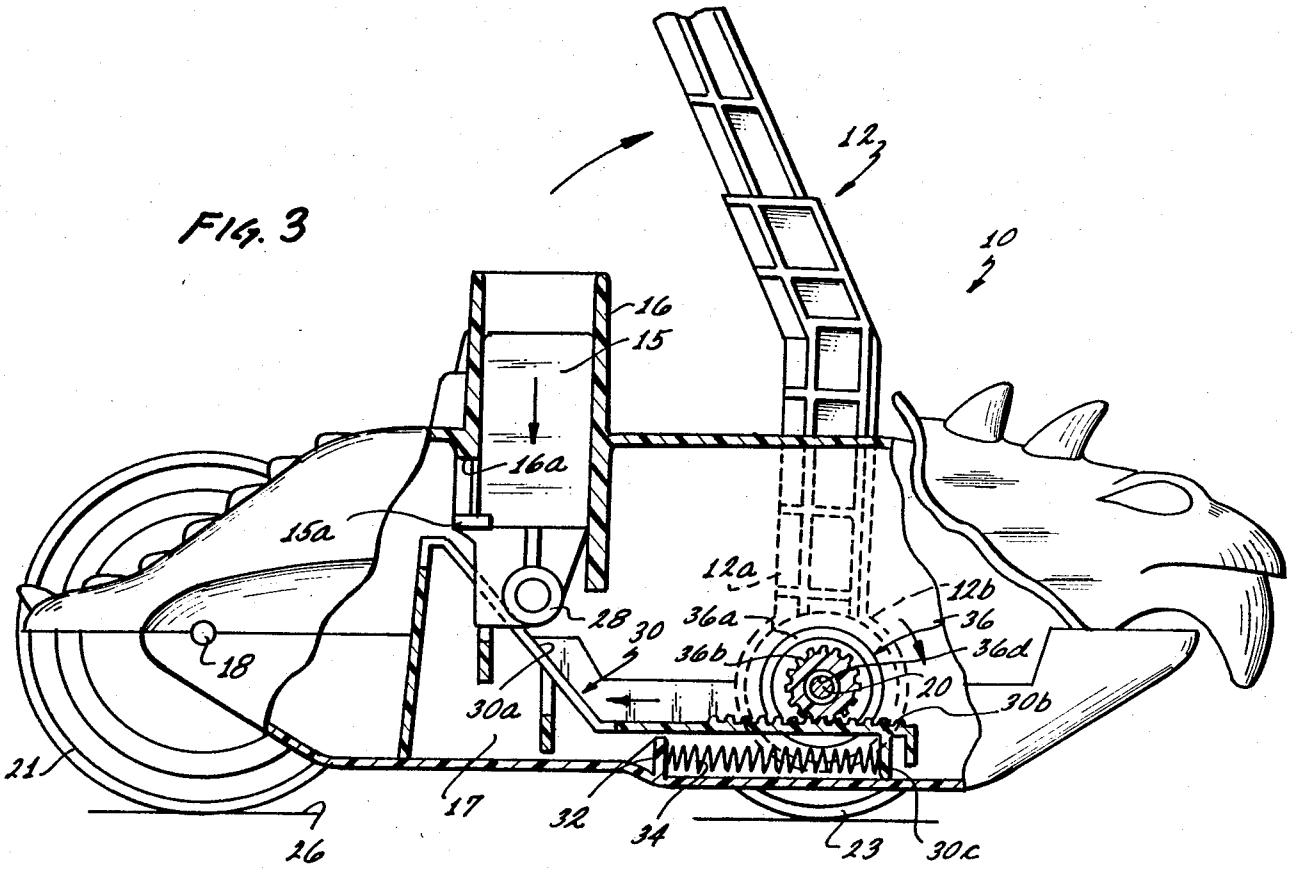
FIG. 3 is a cross-sectional view of the ball swinging toy vehicle of FIGS. 1 and 2, as viewed generally along line 3—3 of FIG. 2.

Referring also to FIGS. 2 and 3, the vehicle 10 includes a generally hollow housing 17 which may be configured in any form, such as a "dragon" or the like. The housing 17 rotatably supports first and second spaced axles 18 and 20 therein, the axle 18 supporting wheels 21 and 22 at the opposite ends thereof, with the axle 20 supporting wheels 23 and 24 at opposite ends thereof, the wheels 21–24 being positioned externally of the housing 16 for engagement with a supporting surface 26.

As best illustrated in FIG. 2, the arm 12 has a first portion 12*a* with an enlarged boss 12*b* at the end thereof, the boss 12*b* having an aperture 12*d* therethrough for being rotatably received on the axle 20. The other end 12*c* of arm 12 extends at an angle to the portion 12*a* with the ball 13 secured to the end thereof, this angular inclination of arm portion 12*c* placing the ball 13 at a position generally centrally with respect to the longitudinal centerline of the vehicle 10. The boss 12 also forms a part of the actuating mechanism which will be described later.

The guide portion 16, as shown in FIG. 3, is a generally rectanguar chute which extends into the interior of housing 17, and slidably supports the control lever 15, the lower end of which has a bearing portion 28 which coacts with a ramp portion 30*a* of a rack member generally designated 30. On the interior of the housing 17, the control lever 15 is provided with a stop lip 15*a* which abuttingly engages a stop edge 16*a* formed on the interior of housing 17 at the lower edge of guide portion 16.

The rack member 30 is arranged within the housing for slidable movement in a longitudinal direction relative to the vehicle 10, that is from front to rear, upon vertical depression of the control lever 15. The forward end of rack member 30 includes a toothed rack portion 30*b*, the lower surface of which is generally planar with a downwardly depending edge 30*c*.

The interior of housing 17 has an integrally formed upwardly extending lip 32 positioned to be in generally parallel relation, and in alignment, with the edge 30*c* of rack member 30 when assembled in housing 17. A compression spring member 34 is positioned between edge 30*c* of rack member 30 and lip 32 to urge rack member 30 to the right as viewed in FIG. 3, this position being referred to as the normal position. Upon depression of control lever 15, the coaction of the bearing portion 28 with the ramp portion 30*a* of the rack member 30 operates the rack member against the force of the spring 34.

Figures 4, 5:
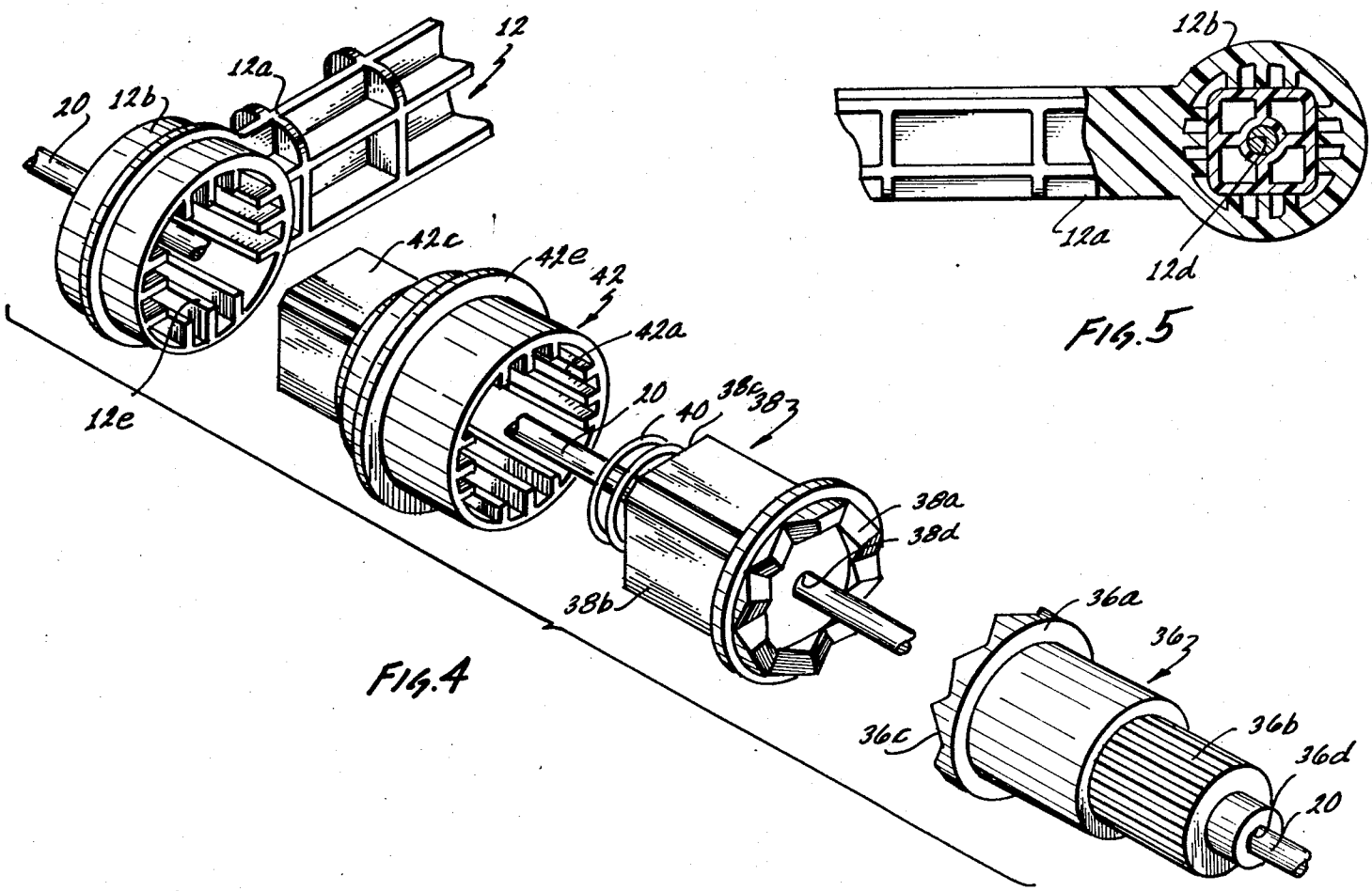
FIG. 4 is an exploded perspective view of the arm actuating mechanism of the vehicle of FIG. 1.
FIG. 5 is a cross-sectional view taken generally along line 5—5 of FIG. 2.

Referring to FIG. 4, briefly, the balance of the actuating mechanism includes a pinion member, generally designated 36, a clutch member, generally designated 38, a clutch spring 40, a coupling member, generally designated 42, and the previously mentioned boss portion 12*b* of arm 12, these parts being rotatably assembled on the front axle 20.

The pinion member 36 has a flange portion 36*a* and a pinion gear portion 36*b* configured for engagement with the rack portion 30*b*. The flange portion 36*a* has a serrated face 36*c* configured for engagement with a matingly configured face 38*a* of the clutch member 38, these two faces generally acting as a clutch means as will be hereinafter described.

The opposite end of the clutch member 38 has a square shank portion 38*b* configured for sliding engagement within a matingly configured square aperture 42*a* of coupling member 42, with the intercoupling providing for concurrent rotation. Although the aperture 42*a* as shown in FIG. 4 is formed of truncated ribs, these truncated ribs essentially form a generally rectangular, or square opening for matingly receiving the square shank portion 38*b* of clutch member 38. The clutch spring 40 encircles the axle 20 intermediate the face 38*c* of the square shank portion 38*b* of the clutch member 38, and, when assembled, the spring 40 urges this face 38*c* and the seat 42*b* formed in coupling member 42 at the bottom of the square aperture 42*a* (See FIG. 2) away form each other.

The coupling member 42 has a centrally located flange portion 42*e* and a square shank portion 42*c*, configured for mating engagement within a square aperture portion 12*e* within boss 12*b* of the arm member 12 (See also FIG. 5), again to provide concurrent rotation of the interconnected parts. The square aperture 12*e* is formed of truncated ribs, similar to the square aperture 42*a*, such openings being normal to a molded plastic part. As shown in FIG. 2, the square shank portion 42*c* extends through an opening in the sidewall of the housing 17, with the square shank portion 42*c* being received in, and secured to, the square aperture 12*e* of the boss portion 12*b* for simultaneous pivoting. It is to be understood that the square shank and square openings are essentially spline means, and may take any convenient form, this particular configuration being shown as illustrative of a splined arrangement.

Each of the parts over the axle 20 includes an axially extending aperture for being rotatably received thereon, that is, pinion member 36 has an axially extending aperture 36*d*, clutch member 38 has an axially extending aperture 38*d* and coupling member 42 has an axially extending aperture 42*d*. All of said axially extending apertures may be slightly larger in diameter than the diameter of the axle 20 for rotation relative to the axle 20, with the wheels 23 and 24 being secured to the axle 20 for rotation therewith. In this manner, the rotation of the parts is independent of the movement of the vehicle, and dependent on the movement of the rack member 30.

By reference to FIG. 2, the parts are shown in assembled position on the axle 20. The bottom interior of the housing 17 is provided with integrally formed first and second, generally parallel web portions 50 and 60, the centers of which are in alignment with the axle 20. These web portions 50 and 60 coact with the actuating mechanism to limit or permit limited movement of one or more of the parts. As shown, the web portion 50 is positioned intermediate the flange 36*a* of the pinion member 36 and the rack member 30 to thereby preclude axial displacement of the pinion member 30 in the direction of the rack member 30.

The web portion 60 is positioned generally parallel to the opening 17*a* of the sidewall of housing 17 through which the shank 42*c* extends, the opening 17*a* being generally circular and of a diameter slightly greater than the diagonal of the shank 42*c*. A flange portion 42*f* of coupling member 42 abuts against the interior of housing 17 adjacent opening 17*a*, with the enlarged flange portion 42*e* being captively restrained from axial movement by the web portion 60. Although not shown, these web portions 50 and 60 would have circular or semi-circular cutouts which, in diameter, would be smaller then the diameter of the corresponding flange engaged. However, due to the spring-loaded, slidable interconnection between the square opening 42*a* of coupling member 42 with the square shank portion 38*b* of the clutch member 38, the face 38*a* of clutch member 38 engages the matingly serrated face 36*a* of the pinion member 36, for concurrent rotation when so engaged, provided no other forces are operating on the mechanism as will be described.

A description of the operation of the apparatus will now be given, with primary reference to FIGS. 2 through 5. As shown in FIG. 2, with the actuating components rotatably assembled on the axle 20, and the slidable coupling of the square shank portion 38*b* of clutch member 38 within the square aperture 42*a* of coupling member 42, axial displacement of the two parts is permitted, with separation of the two clutch faces 36*a* and 38 of the pinion member 36 and the clutch member 38, respectively being permitted upon force being applied to pivot the arm 12, so long as the rack 30 is stationary. This clutch mechanism enables initial setting of the arm 12 to a nested position, that is, the position shown in solid lines in FIG. 1, with the ball 13 at the rear of the vehicle 10.

In the normal unactuated position, by reference to FIG. 3, the rack 30, under force of the spring 34 will be urged to the rightmost position as viewed in this figure, with the topmost edge of ramp portion 30*a* of rack member 30 effectively forcing the control lever 15 to its uppermost or normal position through coaction of the bearing portion 28 of control lever 15 therewith.

As the control lever 15 is depressed, as shown by the arrow thereon in FIG. 3, the rack portion 30*b* of the rack member 30 is in engagement with the pinion portion 36*b* of the pinion member 36, and as the rack member 30 moves rearwardly, in the direction indicated by the arrow adjacent thereto, the pinion member 36, and consequently the boss portion 12*b* of the arm 12 rotate in a clockwise direction, as indicated by the arrow adjacent thereto, thus swinging, or pivoting the arm 12 in a clockwise direction, as indicated by arrow 44. This swings the ball 13 in a direction toward the forward end of the vehicle 10, as depicted by dotted lines 12' and 12'' in FIG. 1, until ultimately the ball 13 impacts with objects forward of the vehicle 10, such as the blocks or cubes 14.

Upon impact, the clutch means heretofore described, act as a means for cushioning the shock of impact. That is, when the ball 13 impacts with an object prior to full depression of the control lever 15, continued depression of the lever 15 may be effected with no corresponding movement of the simulated weight means, or ball 13 due to the separation of the toothed faces 36*a* and 38*a* of the pinion member 36 and clutch member 38. Essentially, upon further depression of the lever 15 with the ball 13 against a relatively immovable object, pinion member 36 rotation continues, but due to the intercoupling of arm 12 through the coupling member 40 and the clutch member 38, these parts will not rotate. With the clutch means, when the control lever 15 is fully raised, the arm 12 may be rotated the angular increment required to its nested position for reactuation by the operator, or to some intermediate position less than fully rearwardly, if desired by the operator.

While there has been shown and described a preferred embodiment, it is to be understood that various other adaptations and modifications may be made within the spirit and scope of the invention.

We claim:

1. In combination with a toy vehicle including a housing, an axle coupled to said housing, and at least one ground-engaging wheel on said axle for moving said vehicle to different positions on a supporting surface, the improvement which comprises:

an arm member having a first end coupled to said axle for pivotable movement relative to the vehicle;

simulated weight means affixed to the other end of said arm member;

manually operable control means on said vehicle; and means interoperatively interconnecting said control means and said first end of said arm member including rack and pinion means for enabling pivoting of said arm member in response to operation of said control means, whereby said arm member may be swung from a nested position relatively within said vehicle to a position outside of said vehicle thereby bringing said simulated weight means into engagement with an object or the supporting surface.

2. The combination according to claim 1 wherein said pinion means are interconnected through clutch means to said first end of said arm member for enabling relative movement between said arm member and said pinion means in one direction.

3. In combination with a toy vehicle including a housing, an axle coupled to said housing, and at least one ground-engaging wheel on said axle for moving said vehicle to different positions on a supporting surface, the improvement which comprises:

an arm member having a first end coupled to said axle for pivotable movement relative to the vehicle;

simulated weight means affixed to the other end of said arm member;

manually operable control means on said vehicle; and means interoperatively interconnecting said control means and said first end of said arm member including actuating means on said axle at least partially coupled to said first end of said arm member for enabling pivoting of said arm member in response to operation of said control means, whereby said arm member may be swung from a nested position relatively within said vehicle to a position outside of said vehicle thereby bringing said simulated weight means into engagement with an object or the supporting surface.

4. The combination according to claim 3 wherein said interoperatively interconnecting means includes a rack-member coacting with said actuating. means.

5. The combination according to claim 4 wherein said actauating means includes pinion means and said rack member has a rack portion in meshing engagement with said pinion means.

6. The combination according to claim 5 wherein said control means is a manually depressible member and said rack member is slidably mounted within said housing and includes a ramp portion in coaction with said manually depressible member for slidably moving said rack member in response to operation of said manually depressible member.

7. The combination according to claim 6 wherein said actuating means includes clutch means for enabling relative movement between said arm member and said pinion means.

8. In combination with a toy vehicle including a housing, an axle coupled to said housing, and at least one ground-engaging wheel on said axle for moving said vehicle to different positions on a supporting surface, the improvement which comprises:

an arm member having a first end coupled to said axle for pivotable movement relative to the vehicle;

ball means affixed to the other end of said arm member;

means on said axle at least partially coupled to said first end for enabling actuation of the pivoting of said arm member;

manually operable control means on said vehicle; and means interoperatively interconnecting said contol means and said means on said axle for enabling pivoting of said arm member in response to operation of said control means, whereby said arm member may be swung from a nested position relative to said vehicle to a position outside of said vehicle thereby bringing said ball means into engagement with an object or the supporting surface.

9. The combination according to claim 8 wherein said means on said axle includes pinion means and said interoperatively interconnecting means includes rack means.

10. The combination according to claim 9 wherein said means on said axle includes clutch means intermediate said arm member and said pinion means for enabling relative movement between said arm member and said pinion means.

11. The combination accordiing to claim 10 wherein said rack means includes a rack member having a ramp portion and a rack portion in meshing engagement with said pinion means.

12. The combination according to claim 11 wherein said manually operable control means includes a manually depressible control member, and said control member coacts with said ramp portion for rotating said pinion means.

13. The combination according to claim 12 wherein said rack member is spring-biased and slidably mounted within said housing.

14. The combination according to claim 9 wherein said rack means is a rack member slidably mounted within said housing, said rack member having a rack portion, and said pinion means includes a pinion portion in meshing engagement with said rack portion.

15. The combination according to claim 14 wherein said rack member is spring-biased in a direction against the force of depression of said control member and said means on said axle includes spring-biased clutch means intermediate said pinion means and said first end of said arm for enabling relative movement between said arm and said pinion means in response to one of force and restraint on said arm.

* * * * *